US006626296B1

(12) United States Patent
Jimu et al.

(10) Patent No.: US 6,626,296 B1
(45) Date of Patent: Sep. 30, 2003

(54) PACKAGE HAVING A CONTAINER CONTAINING A MOISTURE-SENSITIVE SUBSTANCE

(75) Inventors: Masami Jimu, Shiga (JP); Minoru Fukuzawa, Shiga (JP)

(73) Assignee: Kabushiki Kaisha Alpha Giken, Osaka (JP)

( * ) Notice: Subject to any disclaimer, the term of this patent is extended or adjusted under 35 U.S.C. 154(b) by 0 days.

(21) Appl. No.: 09/492,390

(22) Filed: Jan. 27, 2000

(30) Foreign Application Priority Data

Jan. 27, 1999 (JP) ..... 11/018188

(51) Int. Cl.[7] ..... B65D 35/00

(52) U.S. Cl. ..... 206/447; 222/107; 206/813; 428/35.2

(58) Field of Search ..... 206/219, 447, 206/484, 813; 222/94, 95, 107; 428/35.2, 35.3

(56) References Cited

U.S. PATENT DOCUMENTS 4,358,028 A * 11/1982 Chiquiar-Arias ..... 222/107
4,514,446 A * 4/1985 Kadono et al. ..... 222/94 X
4,685,591 A 8/1987 Schaefer et al.
4,698,247 A * 10/1987 Murray et al. ..... 206/484
4,777,085 A * 10/1988 Murray, Jr. et al. ..... 428/35
4,917,267 A * 4/1990 Laverdure ..... 222/107
4,986,053 A * 1/1991 Schaefer ..... 222/107 X
5,322,880 A * 6/1994 Columbus et al. ..... 206/813 X
5,649,648 A * 7/1997 Lier et al. ..... 222/206
5,743,401 A * 4/1998 Takahashi ..... 206/447
5,984,088 A * 11/1999 Dietz et al. ..... 206/205

* cited by examiner

*Primary Examiner*—John G. Weiss
*Assistant Examiner*—Michael J. Fisher
(74) *Attorney, Agent, or Firm*—Armstrong, Westerman & Hattori, LLP

(57) ABSTRACT

A package has a container containing therein contents including a moisture-sensitive substance. The container is provided, on the outside surface of the main sidewall portion thereof, with a metal foil-containing laminated film by welding so that the laminant film may cover at least the whole surface of the main sidewall portion. At least the sidewall portion of the container is preferably made of a molded polyolefin substrate having thickness of not less than 100 $\mu$m.

4 Claims, 3 Drawing Sheets

PACKAGE HAVING A CONTAINER CONTAINING A MOISTURE-SENSITIVE SUBSTANCE

FIELD OF THE INVENTION

The present invention relates to a package comprising a moisture-sensitive substance, such as a 2-cyanoacrylate-based composition, as packed in a container comprising a metal foil-based laminated film as one constituent material.

BACKGROUND OF THE INVENTION

2-Cyanoacrylate-based quick-setting or instantaneous adhesives have rapid curability and therefore have come into wide use as industrial or domestic adhesives.

When applied to adherends, 2-cyanoacrylate-based quick-setting adhesives are rapidly cured by means of moisture in the air by the mechanism of anionic polymerization. This means that when such adhesives are packed in containers for the purpose of distribution, the container material selected should be sufficiently low in moisture permeability and the inside wall material to be in contact with the contents should be free of any additive that may promote anionic polymerization.

Among various resins, polyethylene has the lowest moisture permeability. In the case of low-density polyethylene, the moisture permeability per 30 $\mu$m is about 19 g/m$^2$·24 hrs, for instance, and, in the case of high-density polyethylene, it is about 5 g/m$^2$·24 hrs, for instance. When the film thickness is increased, the moisture permeability decreases in proportion to the thickness. It is also possible to mold polyethylene into containers without adding molding additives such as a lubricant. In these circumstances, polyethylene containers made by blow molding and having a required thickness are generally used as containers for 2-cyanoacrylate-based quick-setting adhesives.

Since aluminum is excellent in ductility, a raw material aluminum slab can be made up into a tubular container by placing said slab in a die and applying thereto an instantaneous pressure by means of a punch. The moisture permeability of aluminum is substantially close to zero and much lower than those of polyethylene species as mentioned above. Therefore, tubular aluminum containers are also generally used as containers for 2-cyanoacrylate-based quick-setting adhesives.

2-Cyanoacrylate-based quick-setting adhesives are packed in medium portions (e.g. 20 g or 30 g) or large portions (e.g. 50 g or 100 g) into containers and placed on the market. They are also put on the market in portions not larger than 10 grams, especially in portions not larger than 5 grams, in many instances. This is because, in many cases, only a very small amount of a 2-cyanoacrylate-based quick-setting adhesive is used in each use thereof for repairing or constructing an article and because once the nozzle opening is opened, the contents may be cured within the nozzle opening after the lapse of many days until the next occasion of use.

The above-mentioned blow-molded polyethylene containers or tubular aluminum containers are used also as containers for 2-cyanoacrylate-based quick-setting adhesives packed in small portions such as 10 grams or less, in particular 5 grams or less, or 2 grams or 3 grams. In the case of small capacity products, however, the internal surface area per gram of a quick-setting adhesive is relatively large and therefore the storage stability of the quick-setting adhesive tends to decrease a the volume of the contents decreases, raising a problem to be solved because of the products being small-sized ones.

Thus, when blow-molded polyethylene containers are used for small-sized products, the use of low-density polyethylene as the polyethylene may secure squeezability owing to its elasticity, but leads to an impairment in stability of the contents because of its moisture permeability. Therefore, it is necessary, in producing blow-molded small capacity containers, to use high-density polyethylene lower in moisture permeability. However, blow-molded high-density polyethylene containers are rigid and therefore, in the case of small-sized products, the squeezability of containers with a small diameter is sacrificed and, even when the sidewall portion of each container is pressed by means of fingers, the contents are hardly squeezed out. When compared with tubular aluminum containers, high-density polyethylene containers are markedly inferior in moisture permeation preventing ability and, when the wall thickness of such containers is increased for further reducing the moisture permeability, the squeezability becomes worsened. It is also a practice to attach the level comprising an aluminum vapor-deposited film with an adhesive layer to a blow-molded high-density polyethylene container. This is, however, only for the purpose of display and/or indication and no effect can be expected in reducing the moisture permeability of the container.

On the contrary, tubular aluminia containers are substantially impermeable to moisture and therefore favorable to the storage stability of quick-setting adhesives. However, when the sidewall portion is pressed with fingers, they fail to restore the initial shape due to the nature of the material. Thus, when the contents have a low viscosity, it is difficult to control the amount to be squeezed out, hence an excess amount may readily be squeezed out. When the contents have a high viscosity, there arises a substantial problem in that the containers are inconvenient for handling in squeezing out the contents, for example the contents may drip after squeezing out due to the residual pressure. A technique is conceivable which comprises inserting a polyethylene tube into a tubular aluminum container to thereby provide the container with restoring ability (repulsiveness). This technology, however, necessarily increases the cost.

Aluminum-based laminated tubes made of a laminated film having the layer constitution polyethylene layer/aluminum foil/substrate film layer are known for packaging foodstuffs and other articles, although they are not concerned with containers for 2-cyanoacrylate-based quick-setting adhesives. When such aluminum-based laminated tubes are applied to containers for such a quick-setting adhesive, the quick-setting adhesive leaking through the polyethylene layer necessarily causes interfacial peeling between the polyethylene layer and aluminum foil.

With such background art, the present invention has for its objects to provide a package comprising a moisture-sensitive substance, such as a 2-cyanoacrylate-based composition, packed in a container, which package has practical storage stability owing to the low moisture permeability of the container even when said package is a small-sized product which a small fill of the contents and which package is easy to handle in squeezing out the contents when they are liquid, since the container has squeezability (deformability and restoring ability) and which package also has a light shielding effect and is advantageous from the cost viewpoint.

SUMMARY OF THE INVENTION

The package according to the present invention comprises the contents L comprising a moisture-sensitive substance as packed in a container 1 and is characterized in that said container 1 is provided, on the outside surface of the main sidewall portion 11 thereof, with a metal foil-containing laminated film B by welding so that said laminated film may cover at least the whole surface of said main sidewall portion 11.

Figure 1:
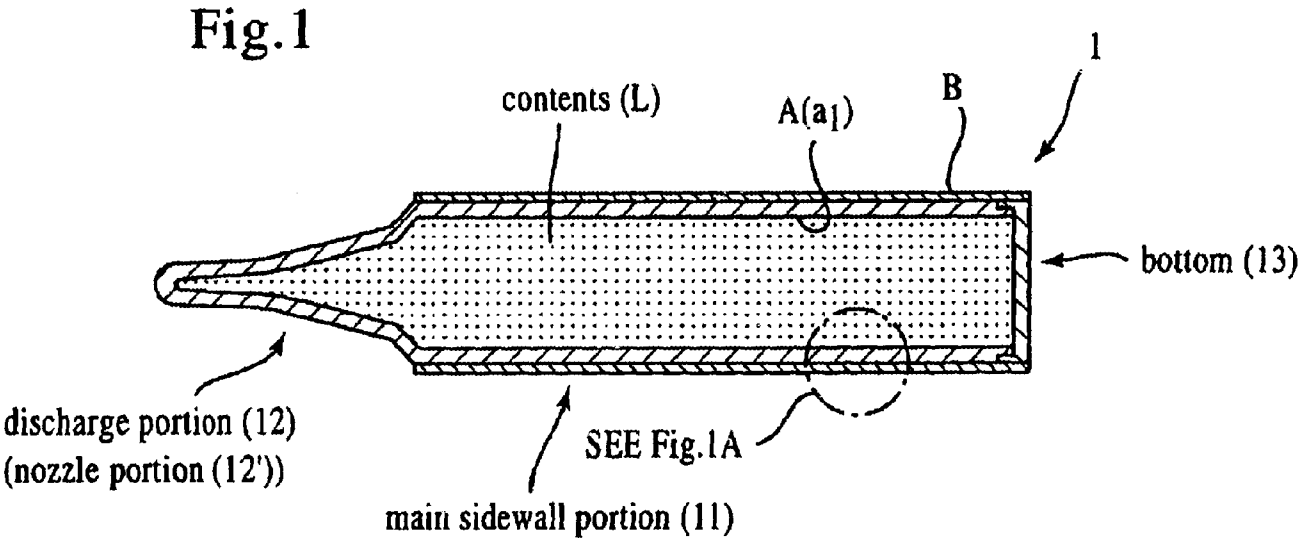
FIG. 1 is a cross-sectional view of an embodiment of the package according to the present invention.
Figure 1A:
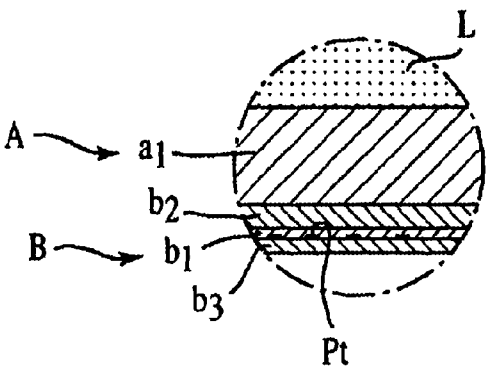

In the figures, 1 denotes a container;

11 the main sidewall portion thereof, 12 a discharge portion, 12' a nozzle portion and 13 a bottom;

A denotes a substrate;

$a_1$ a blow- or injection-molded polyolefin container and $a_2$ an extrusion- or injection-molded polyolefin sheet;

B denotes a metal foil-containing laminated film;

$b_1$ a metal foil, $b_2$ a sealant layer, $b_3$ a substrate film layer, pt a print layer and m a readily breakable portion; and L denotes the contents.

DETAILED DESCRIPTION OF THE INVENTION

The package according to the present invention comprises the contents L comprising a moisture-sensitive substance as packed within the container 1.

The container 1 to be used comprises a discharge portion 12 for discharging the contents L as located at one end of the main sidewall portion 11 and a bottom 13 at the other side of said portion 11, namely has the constitution discharge portion 12/main sidewall portion 11/bottom 13. Further, it may have a cap 14 covering from above the discharge portion 12 to the neck or shoulder portion of the sidewall portion 11. In the following, these portions are illustrated one by one.

The discharge portion 12 includes a delivery portion or a mouth for discharging the contents L. Especially when the contents L are liquid, it is preferred that the discharge portion 12 be a nozzle portion 12'.

This nozzle portion 12' may be simultaneously molded as the main side wall portion 11 having the nozzle portion 12'. Alternatively, after production of the main sidewall portion 11 and the nozzle portion as a separate piece, the latter may be attached to the main sidewall portion 11 at one end thereof by welding, screwing, fitting or like means. The material of the nozzle portion 12' may be arbitrarily selected. When the contents L are a 2-cyanoacrylate-based composition, an injection-molded (or blow-molded) nozzle portion made of high-density or superhigh-density polyethylene with a density of not less than 0.942 is preferred.

The bottom 13 may be molded as a cap tail, which may be attached later to the main sidewall portion 11 (or main sidewall portion 11 having a nozzle portion 12') at tho ether end thereof by welding, screwing, fitting or like means. The main sidewall portion 11 may be molded as one having a bottom and this bottom may be used as the bottom 13. It is also possible to make the main sidewall portion 11 (or main sidewall portion 11 having a nozzle portion 12') and thereafter heating the other end of said main sidewall portion 11 under pressure in a squashing manner to form the bottom 13.

In any case, the space formed by the main sidewall portion 11 with the discharge portion 12 (especially nozzle portion 12') is filled with the contents L and then the above assembly is provided with the bottom 13, or the space formed by the main sidewall portion 11 having the bottom 13 is filled with the contents L and then the assembly is provided with the discharge portion 12 (especially nozzle portion 12'), whereby the package is obtained.

The cap 14 is for covering from above the discharge portion 12 (especially nozzle portion 12') to the neck portion of the main sidewall portion 11 and the type of fixation may be fitting or screwing. The material of the cap 14 is in many cases, but is not limited to, a polyolefin.

In the practice of the present invention, it is especially preferred that at least the main sidewall portion 11 of the container 1 be formed from a substrate A having a thickness of not less than 100 $\mu$m and consisting of a polyolefin molding. Said container 1 is then provided, on the outside surface of the main sidewall portion 11 thereof, with the metal foil-containing laminated film B by welding so that said laminated film may cover at least the whole surface of said main sidewall portion.

More specifically, said substance A is preferably either of the following:

a blow-, injection- or injection blow-molded polyolefin container $a_1$; and an extrusion- or injection-molded polyolefin sheet $a_2$.

The polyolefin includes polyethylene, ethylene, copolymers, polypropylene and the like. Among them, polyethylene is especially important.

When the substrate A is a blow-,injection- or injection blow-molded polyolefin container $a_1$, the container $a_1$ is molded in a cylindrical form. When the substrate A is an extrusion- or injection-molded polyolefin sheet $a_2$, said sheet $a_2$ is rolled into a cylindrical form and both edge portions are butted together and tucked in, or when said sheet is rolled, the starting and terminal edges are superimposed to a certain extent and, thereafter, the portions tucked in or superimposed are welded together under pressure. Such techniques are employed, among others.

Said substrate A is generally required to have a thickness of not less than 100 $\mu$m. When said thickness is less than 100 $\mu$m, the contents L, if they are liquid, may reach the interface with the metal foil-containing laminated film B and possibly cause troubles such as interlayer peeling. The substrate A preferably has a thickness of not less than 200 $\mu$m, in particular not less than 300 $\mu$m. However, an excessive thickness may result in loss of squeezability. Therefore, generally, the upper limit to the thickness of the substrate A should be set at about 500 $\mu$m.

When the polyolefin constituting the substrate A is polyethylene, said polyethylene may be high-, medium- or low-density one in preparing the above-mentioned container, $a_1$ or sheet $a_2$. In that case, high-density polyethylene which is low in moisture permeability is generally more advantageous. Even with high-density polyethylene, squeezability can be secured if the thickness is within the above range.

In each of the above-mentioned container $a_1$ and sheet $a_2$, the inside surface thereof comes into contact with the contents L and, therefore, it is especially preferred, for securing the storage stability, that the polyolefin (in particular polyethylene) constituting the substrate A be a polyolefin (in particular polyethylene) of a grade for molding without additives which is substantially free of such additives as lubricants, fillers, colorants, stabilizer and ultraviolet absorbers.

The metal foil-containing laminated film B has the layer constituent sealant layer/metal foil/substrate film layer, sealant layer/metal foil/sealant layer or sealant layer/metal foil or the like. In each case, the sealant layer serves as the internal layer.

In a particular preferred layer constitution for the metal foil-containing laminated film B, a sealant layer $b_2$ is overlaid on the inside surface of the metal foil $b_1$ and a substrate film layer $b_3$ on the outside surface. In this case and in many instances, the metal foil $b_1$ has a thickness of 5 to 50 $\mu$m (preferably 5 to 25 $\mu$m, more preferably 5 to 20 $\mu$m), sealant layer $b_2$ a thickness of 5 to 100 $\mu$m (preferably 20 to 50 $\mu$m) and the substrate film layer $b_3$ a thickness of 5 to 100 $\mu$m (preferably 5 to 20 $\mu$m). An excessive thickness of each layer will negatively affect the squeezability.

The lamination between the metal foil $b_1$ and sealant layer $b_2$ is mostly carried out by dry lamination or by extrusion coating of the metal foil $b_1$ with a heat-sealable resin such as polyethylene. The lamination between the metal foil $b_1$ and substrate film layer $b_3$ is mostly effected by dry lamination. The inside and/or outside surface of the substrate film layer $b_3$ is generally printed either before of after lamination.

In the above laminated film, the metal foil $b_1$ includes aluminum foils, tin foils and the like. Among them, aluminum foils are used which are generally advantageous from the cost viewpoint. As for the sealant layer $b_2$, one showing good weldability to the substrate A (and the cap 14 as the case may be) is selected from among, for example, high-, medium- and low-density (inclusive of linear low-density) polyethylenes, ethylene, copolymers, polypropylene, propylene copolymers and the like. The substrate film layer $b_3$ includes polyester films, nylon films, polypropylene films and the like. These are generally used in the form of biaxially oriented films.

The container 1 is provided with the metal foil-containing laminated film B generally after the container 1 still in the stage free of the metal foil-containing laminated film B is filled with the contents L and the fill opening is closed. In that case, the technique comprising rolling the container 1 with the constant L on the metal foil-containing laminated film B heated or under heating, or winding the metal foil-containing laminated film B heated or under heating around the container 1 with the contents L is judiciously employed. In that case, the starting and terminal ends of the metal foil-containing laminated film B may be butted together or superimposed with each other to some extent.

The metal foil-containing laminated film B is applied so that it may cover the whole of the main sidewall portion 11 on the outside of the substrate A. It is desirable that said film B cover not only the main sidewall portion but also the basal part of the discharge portion 12 (in particular nozzle portion 12') and that when the bottom 13 is made of a tail cap, said film B cover the circumferential edge of said tail cap.

In providing the outside of the substrate A with the metal foil-containing laminated film B by welding, it is preferred that the whole surface of the metal foil-containing laminated film B be welded. In some cases, however, the metal foil-containing laminated film B may be welded partly, for example in the front, rear and winding end portions.

When the container 1 is provided with the cap 14, it is also possible to design the cap 14 so that the outside diameter thereof becomes equal to the diameter of the main sidewall portion 11 and, after the step of mounting the cap 14, wind the metal foil-containing laminated film B around the main sidewall portion 11 of the container 1 as well as at least part of the cap 14, accompanied by welding.

In such mode of embodiment, the welded, metal foil-containing laminated film B will become a hindrance to the dismounting of the cap 14 prior to use. To solve this point, a readily breakable portion m is desirably provided on the boundary line between the main sidewall portion 11 of the container and the cap 14.

As for the processing for readily breaking, the technique comprising subjecting the corresponding portion of the substrate film layer $b_3$ constituting the metal foil-containing laminated film B to linear local heating can judiciously be employed. The technique comprising perforating the substrate film layer $b_3$ can also be employed as the processing for ready breaking. Such processing for ready breaking allows the boundary portion of the metal foil-containing laminated film as occurring between the main sidewall portion 11 of the container 1 and the cap 14 to readily break by merely turning the cap prior to use, while moisture penetration can be prevented under normal conditions. In the case of application of linear local heating to the metal foil-containing laminated film B, the heated portion may possibly get out of position against the boundary between the main sidewall portion 11 and cap 14 in the step of welding the metal foil-containing laminated film B. Therefore, the local heating is preferably conducted along a plurality of lines. In the case of perforation as well, perforation may be made along a single line or a plurality of lines.

As typical examples of the contents L comprising a moisture-sensitive substance which are to be filled into the container 1 mentioned above, there may be mentioned 2-cyanoacrylate-based compositions.

As for the 2-cyanoacrylate, use is made of an alkyl 2-cyanoacrylate, a cycloalkyl 2-cyanoacrylate, an alkoxyalkyl 2-cyanoacrylate, an alkenyl 2-cyanoacrylate, an alkynyl 2-cyanoacrylate or the like. Among them, the alkyl 2-cyanoacrylate includes methyl 2-cyanoacrylate, ethyl 2-cyanoacrylate, propyl or isopropyl 2-cyanoacrylate, butyl 2-cyanoacrylates, pentyl 2-cyanoacrylates, hexyl 2-cyanoacrylates, octyl 2-cyanoacrylates and the like, and the alkoxyalkyl 2-cyanoacrylate includes ethoxyethyl 2-cyanoacrylate, methoxyethyl 2-cyanoacrylate, methoxyisopropyl 2-cyanoacrylate and the like.

A stabilizer or polymerization inhibitor (e.g. $SO_2$, hydroquinone) is incorporated in such 2-cyanoacrylate. If necessary, a thickening agent, heat resistance improving agent, plasticizer, softening agent, colorant, thixotropy modifier, anionic polymerization promoter, $H^+$ scavenger, pH adjusting agent, ethylene carbonate, organic solvent, filler or polymer and/or a like additive may be added each in an appropriate amount.

The 2-cyanoacrylate-based composition is especially useful as an instantaneous or quick-setting adhesive and, in addition, can be used as a repair agent, reinforcing agent, impregnating agent, putty, coating agent, decorating agent, sealant or sealing agent or the like.

As other examples of the contents L comprising a moisture-sensitive substance, there may be mentioned various liquids which are to be protected against moisture during storage, and organometallic and other compounds readily undergoing hydrolysis. The metal foil-containing laminated film additionally produces a light shielding effect, so that substances requiring protection from light in addition to moisture proofness can be used as well. The contents L may occur not only as a liquid but also as a powder or granules or a solid.

The amount of the contents L (in particular 2-cyanoacrylate-based composition) to be filled in said container 1 can be arbitrarily selected. When the fill amount is large, sufficient reductions in moisture permeability can be obtained by increasing the wall thickness even in the case of ordinary blow-molded polyethylene containers. Therefore, the characteristic features of the package of the present invention are made the best of in cases where the fill amount is small, for example not more than 10 grams (0.5 to 10 g), in particular not more than 5 grams (0.5 to 5 g) or, further, not more than 3 grams (0.5 to 3 g).

Although it is excellent in moisture proofness, the package of the present invention cannot completely shut off moisture. Therefore, it is desirable to put such package or packages in a moisture-proof bag (e.g. bag made of a laminated film composed of a ceramic vapor deposited film and a sealant layer disposed on one side of said ceramic-deposited film) prior to the dispatch for distribution.

In the package of the present invention, at least the main sidewall portion 11 of the container 1 is preferably made of a substrate A which is a polyolefin molding having a thickness of not less than 100 $\mu$m and the metal foil-containing laminated film B is welded on to the outside surface of the substrate A so that said film B may cover at least the whole of the main sidewall portion 11.

Therefore, even in the case of small-capacity products containing the contents L comprising a moisture-sensitive substance in small fill amounts, the contents have practical storage stability owing to the low moisture permeability of the container 1 and, when the contents are liquid, the liquid contents can be readily discharged independently of the viscosity thereof upon pressing the sidewall portion by means of fingers for discharging the contents and the liquid can readily return to the nozzle inside upon removal of the finger pressure since the container 1 has squeezability (deformability and restoring ability). Thus, the package has good operation characteristics.

EXAMPLES

The following examples illustrate the present invention in further detail.

Example 1

<Package>

FIG. 1 is a cross-sectional view of an example of the package of the present invention. In FIG. 1, 1 denotes the container, 11 a cylindrical sidewall portion, 12 a discharge portion (in this example, nozzle portion 12'), 13 the bottom, and L the contents.

Blow-molded (or injection-molded) cylindrical polyethylene containers $a_1$ (an example of the substrate A) having a nozzle portion 12', a capacity for filling 2 grams and a wall thickness of 400 $\mu$m were obtained by blow molding (or injection molding) of a high-density polyethylene species of the grade for molding without using additives which had a density of 0.96. Each of these containers $a_1$ serves as the main sidewall portion 11.

Each container $a_1$ equipped with said nozzle portion 12' was filled with 2 grams of a commercial ethyl 2-cyanoacrylate-based quick-setting adhesive composition as an example of the 2-cyanoacrylate-based composition (an example of the moisture-sensitive substance L) and the container was then provided, by forced fitting, with a tail cap (an example of the bottom 13) prepared by injection molding of a high-density polyethylene species of the grade for molding without using additives which had a density of 0.96, whereby a half-finished package was obtained.

As an example of the metal foil-containing laminated film B, a laminated film having the layer constitution $b_2/b_1/b_3$ composed of a 7-$\mu$m thick aluminum foil $b_1$, a 30-$\mu$m-thick sealant layer $b_2$ of low-melting linear low-density polyethylene as disposed on the internal side of said foil and a 12-$\mu$m-thick polyester film (having a print layer pt on the inside surface) as a substrate film layer $b_1$ as disposed on the external side of said foil was prepared.

Then, the above metal foil-containing laminated film B was placed on a hot plate with the sealant layer $b_2$ facing upwards, and heated to a temperature above the softening point of the sealant layer $b_2$. Then, the above half-finished package was placed on the film B and the metal foil-containing laminated film B was singly wound manually around the half-finished package and welded thereto by overall welding so that said film B might cover the whole of the main sidewall portion 11, the basal portion of the nozzle portion 12' and the peripheral edge of the bottom 13. On that occasion, care was used to attain exact butting of the starting end of the metal foil-containing laminated film B against the terminal end thereof. A desired package was thus obtained.

<Storage stability test>

This package was subjected to an accelerated test comprising allowing it to stand under humid conditions (temperature: 60° C.; humidity: 95% RH) for 35 days and the rate of increase in viscosity was measured. The quick-setting adhesive used as the contents L was a low viscosity grade having a viscosity of 2.1 cps/23° C.

<Dischargeability test>

Said package was observed for dischargeability. The following two ethyl 2-cyanoacrylate-based quick-setting adhesive species were used as the moisture-sensitive substance L:

A low-viscosity grade having a viscosity of 2.1 cps/23° C.;

A medium-viscosity grade having a viscosity of 150 cps/23° C.

<Moisture absorption test>

A package having the same container structure and containing 2 grams of anhydrous calcium chloride in lieu of 2 grams of the quick-setting adhesive as the contents L was used. Said package was further placed in a laminated film bag having the layer constitution polyethylene layer/ceramic vapor deposited polyester film and the whole was subjected to accelerated testing by allowing said whole under humid conditions (60° C.; 95% RH) for 6 days, and the weight increases (due to absorption of moisture by calcium chloride) were measured at timed intervals.

Comparative Example 1

Blow-molded cylindrical polyethylene containers having a nozzle portion, a capacity for filling 2 grams and a wall thickness of 400 $\mu$m were obtained by blow molding of a high-density polyethylene species of the grade for molding without using additives which had a density of 0.96. After filling these containers with 2 grams of a 2-cyanoacrylate-based quick-setting adhesive in the same manner as in Example 1, each container was provided, by forced fitting, with a tail cap prepared by injection molding of a high-density polyethylene species of the grade for molding without using additives which had a density of 0.96, to give a package. This package was tested in the same manner as in Example 1.

Comparative Example 2

A label made of an aluminum vapor deposited film and having an adhesive layer was sticked on the whole circumferential surface of the package of Comparative Example 1. This label-carrying package was tested in the same manner as in Example 1.

Example 2

Figure 2:
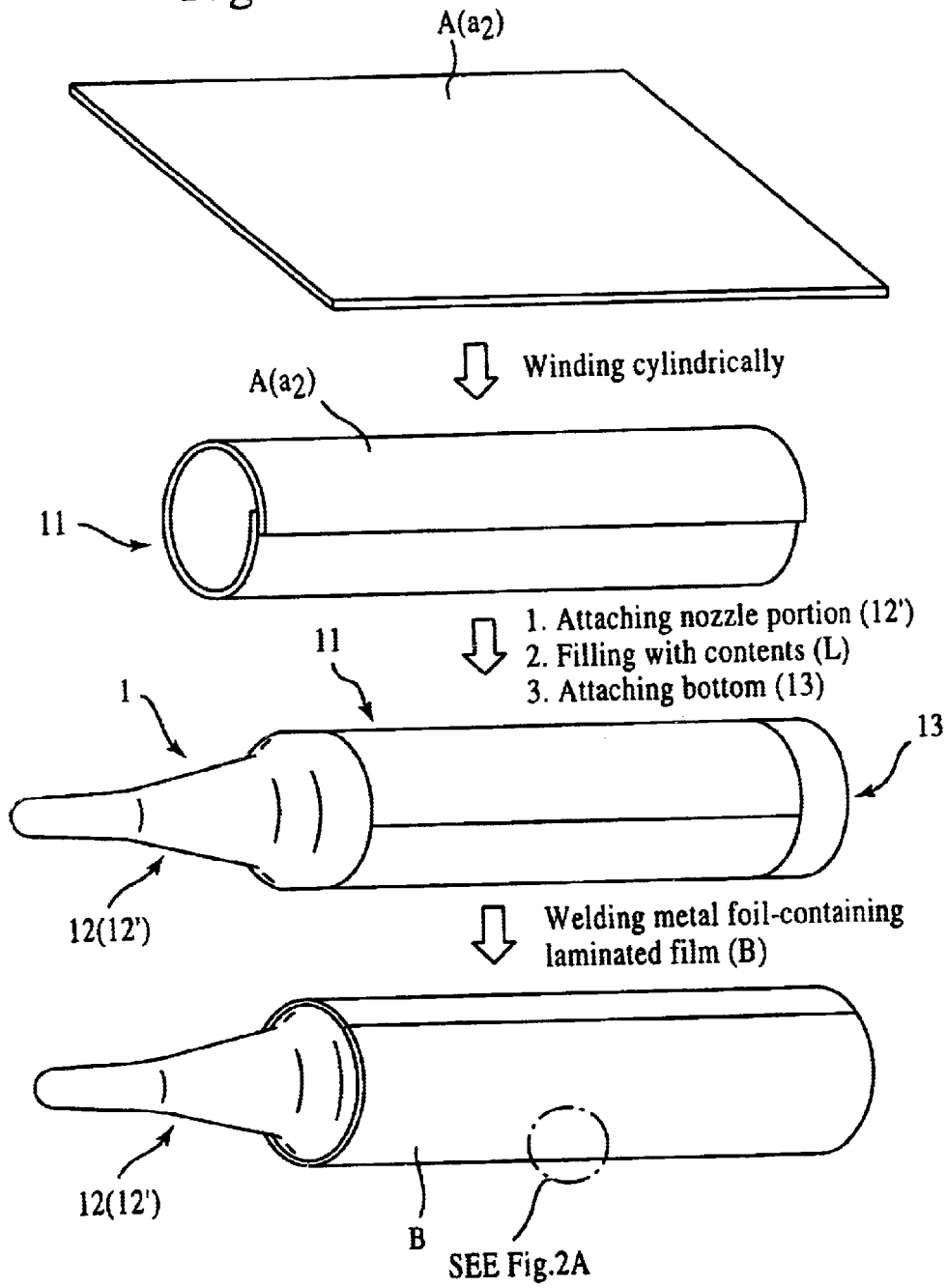
FIG. 2 is an explanatory drawing showing another embodiment of the package according to the present invention.
Figure 2A:
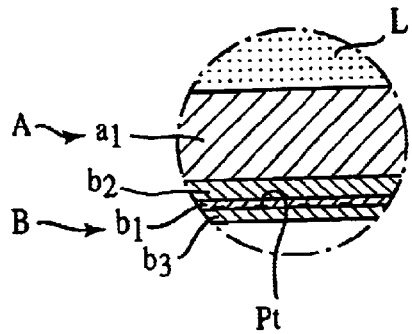

FIG. 2 is an explanatory drawing showing another example of the package of the present invention.

An extrusion-molded (or injection-molded) polyethylene sheet $a_2$ (an example of the substrate A) having a wall thickness of 400 $\mu$m was obtained by extrusion molding (or injection molding) of a low-density polyethylene species of the grade for molding without using additives which had a density of 0.96.

This sheet $a_2$ was wound to give a cylindrical form with the starting and terminal end portions interposing with each other to some extent, and the interposing portions were welded together under pressure to give a cylindrical form.

The basal portion of a nozzle portion 12' prepared by injection molding of high-density polyethylene having a density of 0.96 was attached, by welding, to one end of the main sidewall portion 11 made of said cylindrically shaped sheet $a_2$ and, after filling of 2 grams of a 2-cyanoacrylate-based quick-setting adhesive in the same as in Example 1, the other end of the main sidewall portion 1 was fitted, by welding, with a tail cap (an example of the bottom 13) prepared by injection molding of high-density (density: 0.96) polyethylene of the grade for molding without using additives, to give a half-finished package.

Then, in the same manner as in Example 1, the metal foil-containing laminated film B was placed on a hot plate with the sealant layer $b_2$ facing upwards and heated to a temperature above the softening temperature of the sealant layer $b_2$. The above half-finished package was then placed on the sealant layer and the metal foil-containing laminated film B was singly wound around the half-finished package and welded thereto by overall welding so as to cover the whole of the main sidewall portion 11, the basal portion of the nozzle portion 12' and the peripheral edge of the bottom 13. On that occasion, case was used to attain exact butting of the starting end of the metal foil-containing laminated film B against the terminal end thereof. A desired package was thus obtained. This package was tested in the same manner as in Example 1.

<Results>

The results of the storage stability and moisture absorption tests are shown in Table 1. In Example 1 as well as in Example 2, the dischargeability was good for either of the low viscosity and medium viscosity compositions and was comparable to the case in which the polyethylene container was used; the liquid discharging due to residual pressure as observed with a tubular aluminum container was not observed.

TABLE 1

| | Example 1 | Compar. Ex. 1 | Compar. Ex. 2 | Example 2 |
|---|---|---|---|---|
| Storage stability | | | | |
| Initial viscosity (23° C.) | 2.1 cps | 2.1 cps | 2.1 cps | 2.1 cps |

TABLE 1-continued

| | Example 1 | Compar. Ex. 1 | Compar. Ex. 2 | Example 2 |
|---|---|---|---|---|
| After 35 days of standing | 2.5 cps | Gelation | Gelation | 2.6 cps |
| Moisture absorption (weight increases) | | | | |
| After 1 day | 0.7 mg | 2.7 mg | 2.8 mg | 0.9 mg |
| After 3 days | 2.2 mg | 5.4 mg | 5.6 mg | 2.6 mg |
| After 5 days | 3.6 mg | 8.7 mg | 9.1 mg | 4.2 mg |
| After 6 days | 4.4 mg | 11.9 mg | 12.3 mg | 4.9 mg |

Example 3

Figure 3:
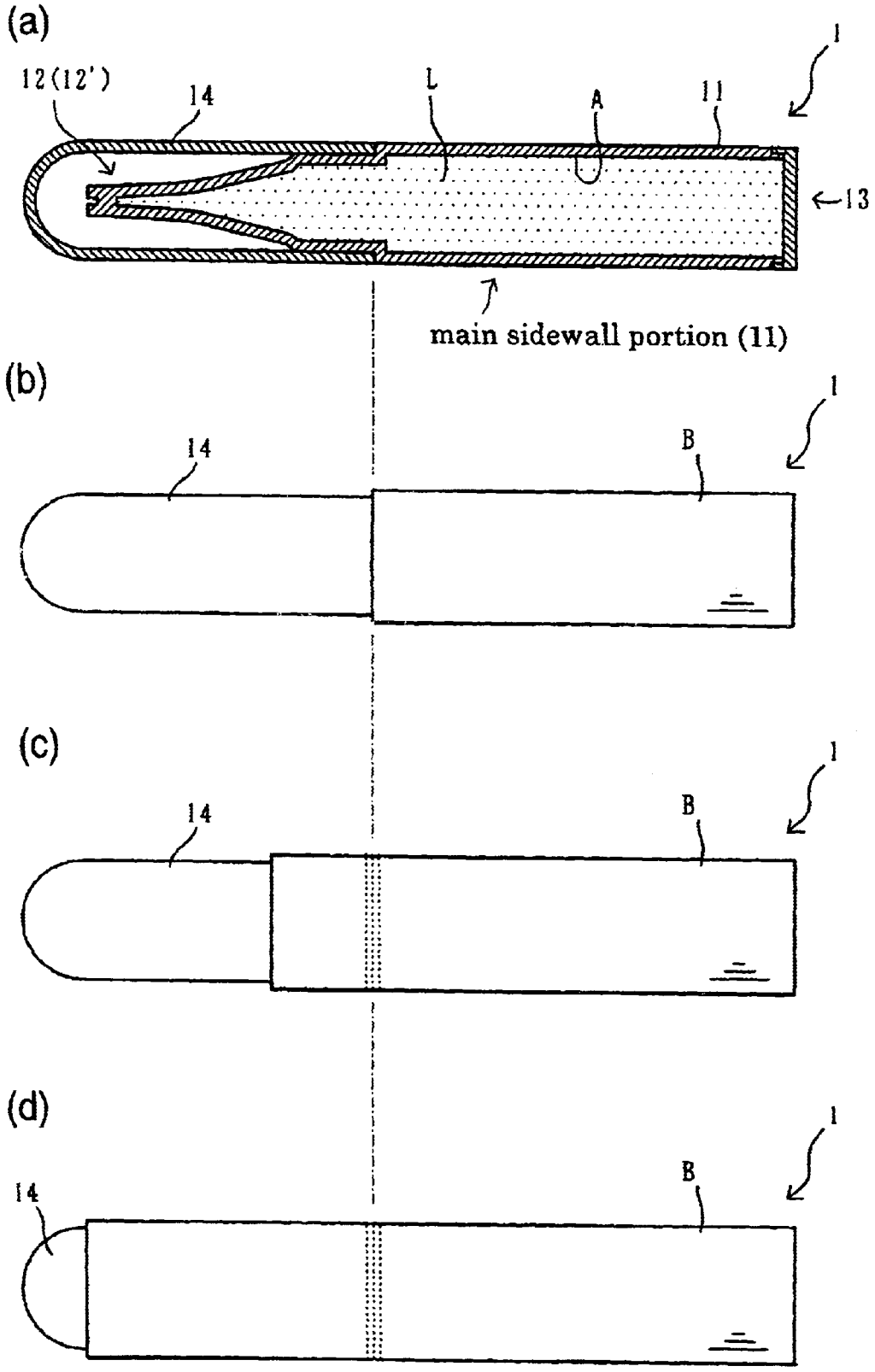
FIGS. 3*a*–3*d* are drawings showing a further embodiment of the package according to the present invention.

FIG. 3 is an explanatory diagram showing a further example of the package of the present invention.

As shown in FIG. 3 (*b*), the same metal foil-containing laminated film B as used in Example 1 was singly wound around a container 1 for a fill of 2 grams having the shape shown in FIG. 3 (*a*) and equipped with a cap 14 having an outer diameter identical to that of the main sidewall portion 11 and welded thereto by overall welding so as to cover the whole of the main sidewall portion 11 and of the peripheral edge of the bottom 13 of said container. Separately, as shown in FIG. 3 (*c*), the same metal foil-containing laminated film B as used in Example 1 was singly wound around the same container 1 as mentioned above and welded thereto by overall welding so as to cover the whole of the main sidewall portion 11 and of the peripheral edge of the bottom 13 and part of the cap 14 of said container 1. Further, separately, as shown in FIG. 3 (*d*), the same metal foil-containing laminated film B as used in Example 1 was singly wound around the same container 1 as mentioned above mechanically and welded thereto by overall welding so as to cover the whole of the main sidewall portion 11 and of the peripheral edge of the bottom 13 and part of the cap 14 of said container 1. In the cases shown in FIGS. 3 (*c*) and (*d*), the substrate film layer $b_3$ of the metal foil-containing laminated film B was provided beforehand with three linear locally heated sections (an example of the readily breakable portion m) on or closely along the boundary between the main sidewall portion 11 of the container 1 and the cap 14 by pressing a heated body against said sections, for facilitating tearing open prior to use.

The containers shown in FIGS. 3 (*a*), (*b*), (*c*) and (*d*) (all showed good squeezability) were tested for moisture absorption in the same manner as in Example 1. The weight increases after 7 days of moisture absorption were 11.0 mg, 3.2 mg, 2.7 mg and 2.0 mg in that order.

As already mentioned hereinabove, the package of the present invention shows good operating characteristics. Thus, even in the case of small-capacity products containing the contents L comprising a moisture-sensitive substance in small fill amounts, the contents have practical storage stability owing to the low moisture permeability of the container 1 and, when the contents are liquid, the liquid contents can be readily discharged independently of the viscosity thereof upon pressing the sidewall portion by means of fingers for discharging the contents and the liquid can readily return to the nozzle inside upon removal of the finger pressure since the container 1 has squeezability (deformability and restoring ability).

In particular when the container 1 is equipped with a cap 14 and the metal foil-containing laminated film B is welded to the container so as to cover not only the main sidewall portion 11 but also at least part of said cap 14, more favorable results can be obtained. In that case, it is preferred that the welded, metal foil-containing laminated film B have a readily breakable portion or portions m on the boundary line between the main sidewall portion 11 of the container 1 and the cap 14.

The welding of the metal foil-containing laminated film B is easy to perform and provides shielding against light. When said metal foil-containing laminated film B is printed, the prints can serve to display the product. Further, the whole container 1 is inexpensive.

What is claimed is:

1. A package containing as contents a 2-cyanoacrylate-based composition as packed in a container, said package being characterized in that said container is provided, on the outside surface of a main sidewall portion thereof, with a metal foil-containing laminated film by overall welding so that said welded laminated film covers at least the whole outside surface of said main side portion;

wherein a discharge portion for discharging the contents is located at one end of the main sidewall portion of the container and a bottom at the other end and wherein at least the main-sidewall portion of the container is made of a substrate which is polyolefin molding having a thickness of not less than 100 $\mu$m;

wherein said substrate is a polyolefin container made of one of blow-, injection- and injection blow-molding, the inside surface of said substrate being in contact with said 2-cyanoacrylate-based composition; said contents amount to not more than 10 grams; and wherein the container is provided with a cap and wherein the metal foil-containing laminated film is provided by overall welding so that said laminated film goes over said main sidewall portion and covers at least part of said cap.

2. A package as claimed in claim 1, wherein the welded, metal foil-containing laminated film is provided with a readily breakable portion on the boundary line between said main sidewall portion of the container and said cap.

3. A package as claimed in claim 2, wherein said readily breakable portion is formed by linear local heating or perforation of the substrate film layer which is a constituent layer of the metal foil-containing laminated film.

4. A method of manufacturing a package which comprises:

providing a container filled with a 2-cyanoacrylate-based composition, the fill amount being not more than 10 grams, the container comprising a main sidewall portion, a discharge portion for discharging the contents located at one end of the main sidewall portion and a bottom at the other end, wherein at least the main sidewall portion of the container is made of a substrate which is a polyolefin molding having a thickness of not less than 100 $\mu$m and wherein said substrate is a polyolefin container made of one of blow-, injection- and injection blow-molding, the inside surface of said substrate being in contact with said 2-cyanoacrylate-based composition, and, winding and welding overall welding a metal foil-containing laminated film around said container filled with the 2-cyanoacrylate-based composition so that said laminated film covers at least the whole outside surface of said main sidewall portion.

* * * * *